US010796653B2

(12) United States Patent
Dai

(10) Patent No.: US 10,796,653 B2
(45) Date of Patent: Oct. 6, 2020

(54) GOA CIRCUIT

(71) Applicant: Wuhan China Star Optoelectronics Technology Co., Ltd., Wuhan, Hubei (CN)

(72) Inventor: Ronglei Dai, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 309 days.

(21) Appl. No.: 15/748,243

(22) PCT Filed: Nov. 27, 2017

(86) PCT No.: PCT/CN2017/113108
§ 371 (c)(1),
(2) Date: Jan. 29, 2018

(87) PCT Pub. No.: WO2019/095427
PCT Pub. Date: May 23, 2019

(65) Prior Publication Data

US 2020/0098327 A1 Mar. 26, 2020

(30) Foreign Application Priority Data

Nov. 17, 2017 (CN) ..... 2017 1 1147136

(51) Int. Cl.
*G09G 3/36* (2006.01)

(52) U.S. Cl.
CPC ... *G09G 3/3677* (2013.01); *G09G 2310/0283* (2013.01); *G09G 2310/08* (2013.01)

(58) Field of Classification Search
CPC ..... G09G 3/3677; G09G 2310/0283; G09G 2310/08
See application file for complete search history.

(56) References Cited

U.S. PATENT DOCUMENTS 8,982,032 B2 * 3/2015 Lee ..... G06F 3/041 345/98
9,190,170 B1 * 11/2015 Hao ..... G09G 3/3677
9,632,611 B1 * 4/2017 Xiao ..... G06F 3/0412
9,875,706 B1 * 1/2018 Gong ..... G09G 3/36
(Continued)

*Primary Examiner* — Grant Sitta
(74) *Attorney, Agent, or Firm* — Hemisphere Law, PLLC; Zhigang Ma

(57) ABSTRACT

A GOA circuit comprises m cascaded GOA units, wherein a GOA unit comprises forward-reverse scan control module, first gate signal output module and second gate signal output module. The forward-reverse scan control module controls the GOA circuit to perform forward scanning or reverse scanning. The first gate signal output module comprises seventh TFT, ninth TFT and sixteenth TFT; a second terminal of the sixteenth TFT receives a high potential signal, and a first and a third terminal of the sixteenth TFT are connected to the first and second terminals of the seventh TFT, respectively. The second gate signal output module comprises twelfth TFT, thirteenth TFT and fifteenth TFT; a second terminal of the fifteenth TFT receives the high potential signal, and a first and a third terminal of the fifteenth TFT are connected to the first and second terminals of the twelfth TFT, respectively.

20 Claims, 2 Drawing Sheets

(56) References Cited

U.S. PATENT DOCUMENTS 10,217,429 B1* 2/2019 Shi ..... G09G 3/3677
2012/0105393 A1* 5/2012 Tan ..... G09G 3/3677 345/204
2013/0173870 A1* 7/2013 Tseng ..... G09G 3/3677 711/154
2014/0118237 A1* 5/2014 Wang ..... G11C 19/28 345/100
2014/0176410 A1* 6/2014 Ma ..... H03K 3/012 345/92
2015/0255031 A1* 9/2015 Cao ..... G09G 3/3677 345/210
2015/0279288 A1* 10/2015 Dai ..... G09G 3/3607 345/690
2015/0310819 A1* 10/2015 Xiao ..... G09G 3/3674 345/212
2015/0325190 A1* 11/2015 Cao ..... G11C 19/28 345/100
2015/0339997 A1* 11/2015 Yang ..... G09G 3/3677 345/212
2016/0042712 A1* 2/2016 Su ..... G09G 3/3696 345/212
2016/0188074 A1* 6/2016 Xiao ..... G06F 3/0416 345/173
2016/0189647 A1* 6/2016 Xiao ..... G09G 3/3677 345/92
2016/0189648 A1* 6/2016 Xiao ..... G09G 3/3677 345/212
2016/0189658 A1* 6/2016 Hao ..... G09G 3/3677 345/212
2016/0247476 A1* 8/2016 Xiao ..... G09G 3/3677
2016/0267832 A1* 9/2016 Dai ..... G09G 3/2092
2016/0293090 A1* 10/2016 Long ..... G09G 3/2092
2016/0343322 A1* 11/2016 Xiao ..... H01L 27/1255
2016/0343323 A1* 11/2016 Xiao ..... H01L 27/124
2016/0343335 A1* 11/2016 Cao ..... G09G 3/36
2017/0140728 A1* 5/2017 Zhao ..... G09G 3/3677
2017/0162153 A1* 6/2017 Zhao ..... G09G 3/3677
2017/0221439 A1* 8/2017 Chen ..... G09G 3/3648
2017/0236479 A1* 8/2017 Li ..... G09G 3/3648 345/213
2017/0236480 A1* 8/2017 Dai ..... G11C 19/28 345/213
2017/0323608 A1* 11/2017 Gong ..... G09G 3/36
2018/0040600 A1* 2/2018 Li ..... G02F 1/13454
2019/0139616 A1* 5/2019 Qian ..... G11C 19/28

* cited by examiner

GOA CIRCUIT

RELATED APPLICATIONS

The present application is a National Phase of International Application Number PCT/CN2017/113108, filed on Nov. 27, 2017, and claims the priority of China Application No. 201711147136.5, filed on Nov. 17, 2017.

FIELD OF THE DISCLOSURE

The disclosure relates to a display technical field, and more particularly to a GOA circuit.

BACKGROUND

As shown in FIG. 1 and FIG. 2, in a normal cascaded (1 to 2) GOA (Gate Driver On Array, a technique using the existed process of manufacturing thin film transistor liquid crystal display array to manufacture a gate line scan driving signal circuit on an array substrate to realize a driving method scanning each gate line in sequence), waveforms of the node Q shown in FIG. 1 while being interfered by signals are shown in FIG. 2.

The potentials of the nodes Qa and Qb are leaked to the node Q through the thin film transistor (TFT) NT7 and the TFT NT12 in the boost period, so that the boost potentials of the nodes Qa and Qb are decreased because the latency of the high potential signal VGH and the interfered potential of the node Q are not matched and the voltage between the gate and the source, either in the TFT NT7 or the TFT NT12, is therefore greater than 0 volt (Vgs>0V) and resulting in the decrease of the boost potentials of the nodes Qa and Qb. As shown in FIG. 2, after the boost potentials of the nodes Qa and Qb are decreased, the potentials of the gates of the TFT NT9 and TFT NT13 are decreased, the output waveforms of the gate signals G(n) and G(n+2) become abnormal, and risk of failure of GOA cascaded transmission appears.

SUMMARY

In order to solve the technique problems mentioned above, the present invention provides a GOA circuit to decrease the risk of failure of GOA cascaded transmission.

The present invention provides a GOA circuit, which is used in a liquid crystal display panel, comprising m cascaded GOA units, wherein a $n^{th}$-stage GOA unit comprises: a forward-reverse scan control module, a first gate signal output module and a second gate signal output module, wherein m≥n≥1;

the forward-reverse scan control module is used for controlling the GOA circuit to perform a forward scanning or a reverse scanning in accordance with a forward scan control signal or a reverse scan control signal;

the first gate signal output module comprises: a seventh thin film transistor (TFT), a ninth TFT and a sixteenth TFT; a third terminal of the seventh TFT receives a high potential signal, a first terminal of the seventh TFT is connected to an output terminal of the forward-reverse scan control module, and a second terminal of the seventh TFT is connected to a third terminal of the ninth TFT; a first terminal of the ninth TFT receives a $n^{th}$ clock signal, and a second terminal of the ninth TFT is for outputting a $n^{th}$ gate driving signal; a second terminal of the sixteenth TFT receives the high potential signal, a first terminal of the sixteenth TFT is connected to the first terminal of the seventh TFT, and a third terminal of the sixteenth TFT is connected to the second terminal of the seventh TFT;

the second gate signal output module comprises: a twelfth TFT, a thirteenth TFT and a fifteenth TFT; a third terminal of the twelfth TFT receives the high potential signal, a first terminal of the twelfth TFT is connected to the output terminal of the forward-reverse scan control module, and a second terminal of the twelfth TFT is connected to a third terminal of the thirteenth TFT; a first terminal of the thirteenth TFT receives a $(n+2)^{th}$ clock signal, and a second terminal of the thirteenth TFT is for outputting a $(n+2)^{th}$ gate driving signal; a second terminal of the fifteenth TFT receives the high potential signal, a first terminal of the fifteenth TFT is connected to the first terminal of the twelfth TFT, and a third terminal of the fifteenth TFT is connected to the second terminal of the twelfth TFT;

wherein, the first terminal is one of source and drain, the second terminal is another one of source and drain, and the third terminal is gate.

Preferably, the forward-reverse scan control module comprises a first TFT and a second TFT;

a first terminal of the first TFT receives the forward scan control signal, a first terminal of the second TFT receives the reverse scan control signal, a second terminal of the first TFT is connected to a second terminal of the second TFT and the first terminal of the seventh TFT, a third terminal of the first TFT receives a $(n-2)^{th}$ gate driving signal, and a third terminal of the second TFT receives a $(n+4)^{th}$ gate driving signal.

Preferably, the GOA unit further comprises a third TFT, a fourth TFT, an eighth TFT, a tenth TFT and a fourteenth TFT;

a first terminal of the third TFT receives a $(n+1)^{th}$ clock signal, and a first terminal of the fourth TFT receives a $(n-1)^{th}$ clock signal;

a second terminal of the third TFT is connected to a second terminal of the fourth TFT and a third terminal of the eighth TFT;

a third terminal of the third TFT receives the forward scan control signal, and a third terminal of the fourth TFT receives the reverse scan control signal;

a first terminal of the eighth TFT receives the high potential signal, and a second terminal of the eighth TFT is connected to a third terminal of the tenth TFT and a third terminal of the fourteenth TFT;

a first terminal of the tenth TFT is connected to the second terminal of the ninth TFT, a first terminal of the fourteenth TFT is connected to the second terminal of the thirteenth TFT, and a second terminal of the tenth TFT and a second terminal of the fourteenth TFT both receive a low potential signal.

Preferably, the GOA unit further comprises an eleventh TFT, a second terminal of the eleventh TFT is connected to a third terminal of the eleventh TFT and receives a reset signal, and a first terminal of the eleventh TFT is connected to the third terminals of the tenth TFT and the fourteenth TFT.

Preferably, the GOA unit further comprises a sixth TFT, a third terminal of the sixth TFT is connected to the second terminal of the second TFT, a first terminal of the sixth TFT is connected to the third terminals of the tenth TFT and the fourteenth TFT, and a second terminal of the sixth TFT receives the low potential signal.

Preferably, the GOA unit further comprises a first capacitor and a second capacitor;

a first terminal of the first capacitor is connected to the first terminal of the seventh TFT, and a second terminal of the first capacitor receives the low potential signal;

a first terminal of the second capacitor is connected to the second terminal of the tenth TFT, and a second terminal of the second capacitor is connected to the third terminal of the tenth TFT.

Preferably, the GOA unit further comprises a fifth TFT, a second terminal of the fifth TFT receives the low potential signal, a first terminal of the fifth TFT is connected to the first terminal of the seventh TFT, and a third terminal of the fifth TFT is connected to the second terminal of the eighth TFT.

Preferably, all the TFT's in the GOA unit are N-channel TFT's.

The present invention further provides a GOA circuit, which is used in a liquid crystal display panel, comprising m cascaded GOA units, wherein a $n^{th}$-stage GOA unit comprises: a forward-reverse scan control module, a first gate signal output module and a second gate signal output module, wherein $m \geq n \geq 1$;

the forward-reverse scan control module is used for controlling the GOA circuit to perform a forward scanning or a reverse scanning in accordance with a forward scan control signal or a reverse scan control signal;

the first gate signal output module comprises: a seventh thin film transistor (TFT), a ninth TFT and a sixteenth TFT; a third terminal of the seventh TFT receives a high potential signal, a first terminal of the seventh TFT is connected to an output terminal of the forward-reverse scan control module, and a second terminal of the seventh TFT is connected to a third terminal of the ninth TFT; a first terminal of the ninth TFT receives a $n^{th}$ clock signal, and a second terminal of the ninth TFT is for outputting a $n^{th}$ gate driving signal; a second terminal of the sixteenth TFT receives the high potential signal, a first terminal of the sixteenth TFT is connected to the first terminal of the seventh TFT, and a third terminal of the sixteenth TFT is connected to the second terminal of the seventh TFT;

the second gate signal output module comprises: a twelfth TFT, a thirteenth TFT and a fifteenth TFT; a third terminal of the twelfth TFT receives the high potential signal, a first terminal of the twelfth TFT is connected to the output terminal of the forward-reverse scan control module, and a second terminal of the twelfth TFT is connected to a third terminal of the thirteenth TFT; a first terminal of the thirteenth TFT receives a $(n+2)^{th}$ clock signal, and a second terminal of the thirteenth TFT is for outputting a $(n+2)^{th}$ gate driving signal; a second terminal of the fifteenth TFT receives the high potential signal, a first terminal of the fifteenth TFT is connected to the first terminal of the twelfth TFT, and a third terminal of the fifteenth TFT is connected to the second terminal of the twelfth TFT;

the forward-reverse scan control module comprises a first TFT and a second TFT;

a first terminal of the first TFT receives the forward scan control signal, a first terminal of the second TFT receives the reverse scan control signal, a second terminal of the first TFT is connected to a second terminal of the second TFT and the first terminal of the seventh TFT, a third terminal of the first TFT receives a $(n-2)^{th}$ gate driving signal, and a third terminal of the second TFT receives a $(n+4)^{th}$ gate driving signal;

wherein, the first terminal is one of source and drain, the second terminal is another one of source and drain, and the third terminal is gate.

Preferably, the GOA unit further comprises a third TFT, a fourth TFT, an eighth TFT, a tenth TFT and a fourteenth TFT;

a first terminal of the third TFT receives a $(n+1)^{th}$ clock signal, and a first terminal of the fourth TFT receives a $(n-1)^{th}$ clock signal;

a second terminal of the third TFT is connected to a second terminal of the fourth TFT and a third terminal of the eighth TFT;

a third terminal of the third TFT receives the forward scan control signal, and a third terminal of the fourth TFT receives the reverse scan control signal;

a first terminal of the eighth TFT receives the high potential signal, and a second terminal of the eighth TFT is connected to a third terminal of the tenth TFT and a third terminal of the fourteenth TFT;

a first terminal of the tenth TFT is connected to the second terminal of the ninth TFT, a first terminal of the fourteenth TFT is connected to the second terminal of the thirteenth TFT, and a second terminal of the tenth TFT and a second terminal of the fourteenth TFT both receive a low potential signal.

Preferably, the GOA unit further comprises an eleventh TFT, a second terminal of the eleventh TFT is connected to a third terminal of the eleventh TFT and receives a reset signal, and a first terminal of the eleventh TFT is connected to the third terminals of the tenth TFT and the fourteenth TFT.

Preferably, the GOA unit further comprises a sixth TFT, a third terminal of the sixth TFT is connected to the second terminal of the second TFT, a first terminal of the sixth TFT is connected to the third terminals of the tenth TFT and the fourteenth TFT, and a second terminal of the sixth TFT receives the low potential signal.

Preferably, the GOA unit further comprises a first capacitor and a second capacitor;

a first terminal of the first capacitor is connected to the first terminal of the seventh TFT, and a second terminal of the first capacitor receives the low potential signal;

a first terminal of the second capacitor is connected to the second terminal of the tenth TFT, and a second terminal of the second capacitor is connected to the third terminal of the tenth TFT.

Preferably, the GOA unit further comprises a fifth TFT, a second terminal of the fifth TFT receives the low potential signal, a first terminal of the fifth TFT is connected to the first terminal of the seventh TFT, and a third terminal of the fifth TFT is connected to the second terminal of the eighth TFT.

Preferably, all the TFT's in the GOA unit are N-channel TFT's.

The present invention further provides a GOA circuit, which is used in a liquid crystal display panel, comprising m cascaded GOA units, wherein a $n^{th}$-stage GOA unit comprises: a forward-reverse scan control module, a first gate signal output module and a second gate signal output module, wherein $m \geq n \geq 1$;

the forward-reverse scan control module is used for controlling the GOA circuit to perform a forward scanning or a reverse scanning in accordance with a forward scan control signal or a reverse scan control signal;

the first gate signal output module comprises: a seventh thin film transistor (TFT), a ninth TFT and a sixteenth TFT; a third terminal of the seventh TFT receives a high potential signal, a first terminal of the seventh TFT is connected to an output terminal of the forward-reverse scan control module, and a second terminal of the seventh TFT is connected to a third terminal of the ninth TFT; a first terminal of the ninth TFT receives a $n^{th}$ clock signal, and a second terminal of the ninth TFT is for outputting a $n^{th}$ gate driving signal; a second terminal of the sixteenth TFT receives the high potential signal, a first terminal of the sixteenth TFT is connected to the first terminal of the seventh TFT, and a third terminal of the sixteenth TFT is connected to the second terminal of the seventh TFT;

the second gate signal output module comprises: a twelfth TFT, a thirteenth TFT and a fifteenth TFT; a third terminal of the twelfth TFT receives the high potential signal, a first terminal of the twelfth TFT is connected to the output terminal of the forward-reverse scan control module, and a second terminal of the twelfth TFT is connected to a third terminal of the thirteenth TFT; a first terminal of the thirteenth TFT receives a $(n+2)^{th}$ clock signal, and a second terminal of the thirteenth TFT is for outputting a $(n+2)^{th}$ gate driving signal; a second terminal of the fifteenth TFT receives the high potential signal, a first terminal of the fifteenth TFT is connected to the first terminal of the twelfth TFT, and a third terminal of the fifteenth TFT is connected to the second terminal of the twelfth TFT;

the GOA unit further comprises a third TFT, a fourth TFT, an eighth TFT, a tenth TFT and a fourteenth TFT;

a first terminal of the third TFT receives a $(n+1)^{th}$ clock signal, and a first terminal of the fourth TFT receives a $(n-1)^{th}$ clock signal;

a second terminal of the third TFT is connected to a second terminal of the fourth TFT and a third terminal of the eighth TFT;

a third terminal of the third TFT receives the forward scan control signal, and a third terminal of the fourth TFT receives the reverse scan control signal;

a first terminal of the eighth TFT receives the high potential signal, and a second terminal of the eighth TFT is connected to a third terminal of the tenth TFT and a third terminal of the fourteenth TFT;

a first terminal of the tenth TFT is connected to the second terminal of the ninth TFT, a first terminal of the fourteenth TFT is connected to the second terminal of the thirteenth TFT, and a second terminal of the tenth TFT and a second terminal of the fourteenth TFT both receive a low potential signal;

the GOA unit further comprises an eleventh TFT, a second terminal of the eleventh TFT is connected to a third terminal of the eleventh TFT and receives a reset signal, and a first terminal of the eleventh TFT is connected to the third terminals of the tenth TFT and the fourteenth TFT;

wherein, the first terminal is one of source and drain, the second terminal is another one of source and drain, and the third terminal is gate.

Preferably, the forward-reverse scan control module comprises a first TFT and a second TFT;

a first terminal of the first TFT receives the forward scan control signal, a first terminal of the second TFT receives the reverse scan control signal, a second terminal of the first TFT is connected to a second terminal of the second TFT and the first terminal of the seventh TFT, a third terminal of the first TFT receives a $(n-2)^{th}$ gate driving signal, and a third terminal of the second TFT receives a $(n+4)^{th}$ gate driving signal.

Preferably, the GOA unit further comprises a sixth TFT, a third terminal of the sixth TFT is connected to the second terminal of the second TFT, a first terminal of the sixth TFT is connected to the third terminals of the tenth TFT and the fourteenth TFT, and a second terminal of the sixth TFT receives the low potential signal.

Preferably, the GOA unit further comprises a first capacitor and a second capacitor;

a first terminal of the first capacitor is connected to the first terminal of the seventh TFT, and a second terminal of the first capacitor receives the low potential signal;

a first terminal of the second capacitor is connected to the second terminal of the tenth TFT, and a second terminal of the second capacitor is connected to the third terminal of the tenth TFT.

Preferably, the GOA unit further comprises a fifth TFT, a second terminal of the fifth TFT receives the low potential signal, a first terminal of the fifth TFT is connected to the first terminal of the seventh TFT, and a third terminal of the fifth TFT is connected to the second terminal of the eighth TFT;

all the TFT's in the GOA unit are N-channel TFT's.

Benefits of the present invention are as follows: Although there is risk existed in reversely leaking potentials of the nodes Qa and Qb through the seventh TFT and the twelfth TFT in the boost period when the connecting point Q connected to the output terminal of the forward-reverse scan control module, the first terminal of the seventh TFT and the first terminal of the twelfth TFT is interfered by signals, the potentials of the nodes Qa and Qb can be kept at normal level and the gate potentials of the ninth TFT and the thirteenth TFT can be kept at normal boost potential by turning on the fifteenth TFT and the sixteenth TFT in the boost period of the nodes Qa and Qb to charge the high potential signal VGH into the node Q to reduce the signal interference of the node Q. Finally, the output waveforms of the $n^{th}$ gate driving signal G(n) and the $(n+2)^{th}$ gate driving signal G(n+2) could be in normal status and the risk of failure of GOA cascaded transmission is reduced.

BRIEF DESCRIPTION OF THE DRAWINGS

In order to make the descriptions of the technique solutions of the embodiments of the present invention or the existed techniques be clearer, the drawings necessary for describing the embodiments or the existed techniques are briefly introduced below. Obviously, the drawings described below are only some embodiments of the present invention, and, for those with ordinary skill in this field, other drawings can be obtained from the drawings described below without creative efforts.

DETAILED DESCRIPTION OF PREFERRED EMBODIMENTS

Figure 1:
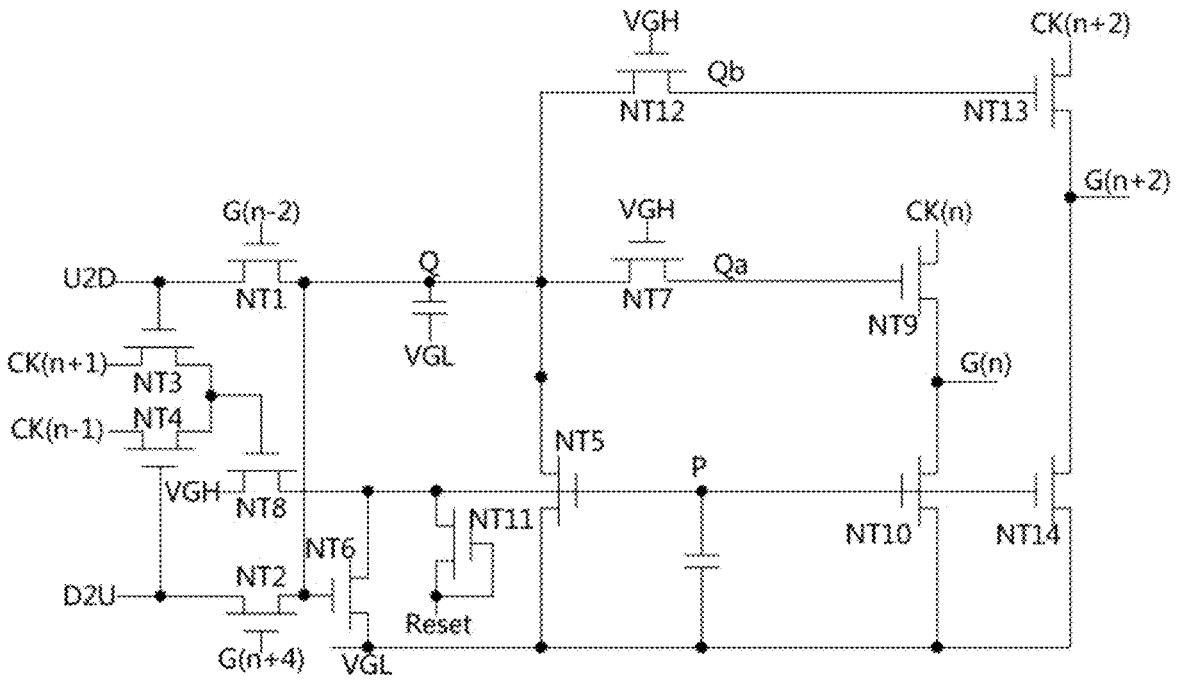
FIG. 1 (Prior Art)
FIG. 1 is a circuit diagram of a GOA circuit provided in the background of the present disclosure.
Figure 2:
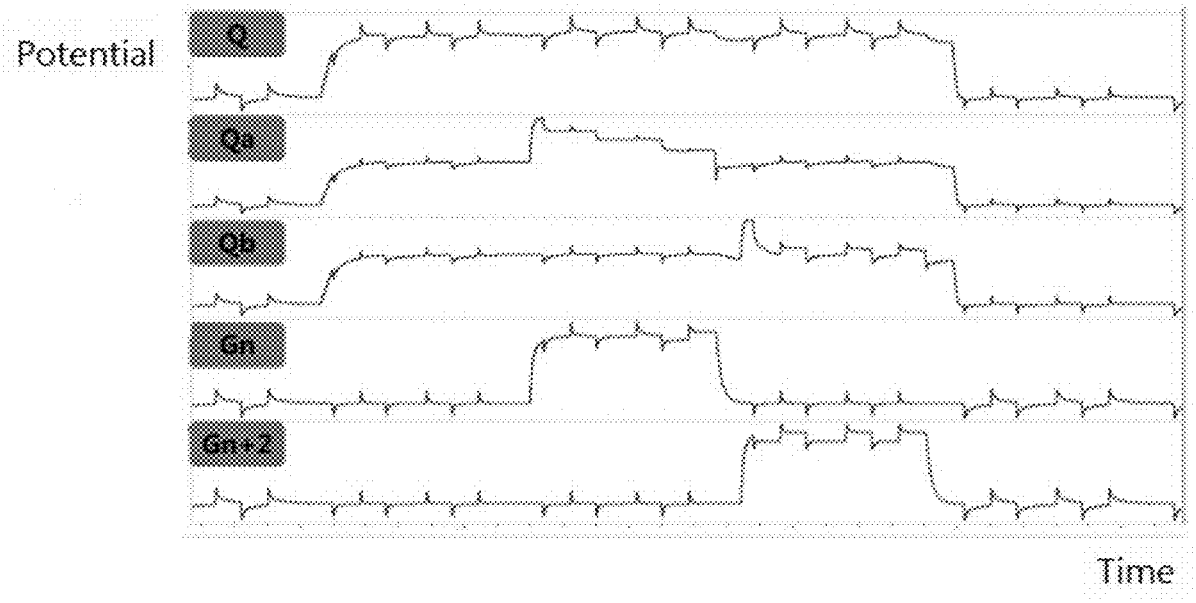
FIG. 2 (Prior Art)
FIG. 2 is a waveform diagram showing waveforms of the node Q, Qa and Qb in the GOA circuit diagram and the output gate driving signals provided in the background of the present disclosure.
Figure 3:
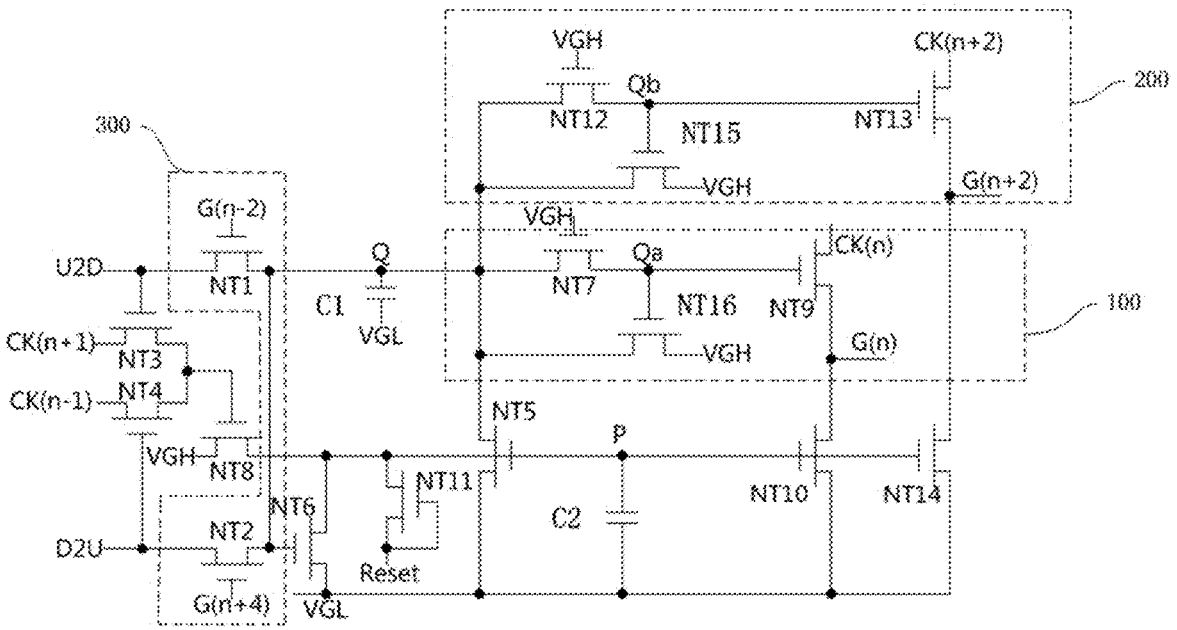
FIG. 3 is a GOA circuit provided by the present invention.

The present invention provides a GOA circuit, which is used in a liquid crystal display panel. As shown in FIG. 3, the GOA circuit comprises m cascaded GOA units, a $n^{th}$-stage GOA unit comprises: a forward-reverse scan control module 300, a first gate signal output module 100 and a second gate signal output module 200, wherein m≥n≥1.

The forward-reverse scan control module 300 is used for controlling the GOA circuit to perform a forward scanning or a reverse scanning in accordance with a forward scan control signal U2D or a reverse scan control signal D2U.

The first gate signal output module 100 comprises: a seventh thin film transistor (TFT) NT7, a ninth TFT NT9 and a sixteenth TFT NT16. A third terminal of the seventh TFT NT7 receives a high potential signal VGH, a first terminal of the seventh TFT NT7 is connected to an output terminal of the forward-reverse scan control module 300, and a second terminal of the seventh TFT NT7 is connected to a third terminal of the ninth TFT NT9; a first terminal of the ninth TFT NT9 receives a $n^{th}$ clock signal CK(n), and a second terminal of the ninth TFT NT9 is for outputting a $n^{th}$ gate driving signal G(n); a second terminal of the sixteenth TFT NT16 receives the high potential signal VGH, a first terminal of the sixteenth TFT NT16 is connected to the first terminal of the seventh TFT NT7, and a third terminal of the sixteenth TFT NT16 is connected to the second terminal of the seventh TFT NT7. The point connected between the seventh TFT NT7 and the ninth TFT NT9 is used as a node Qa.

The second gate signal output module 200 comprises: a twelfth TFT NT12, a thirteenth TFT NT13 and a fifteenth TFT NT15. A third terminal of the twelfth TFT NT12 receives the high potential signal VGH, a first terminal of the twelfth TFT NT12 is connected to the output terminal of the forward-reverse scan control module 300, and a second terminal of the twelfth TFT NT12 is connected to a third terminal of the thirteenth TFT NT13; a first terminal of the thirteenth TFT NT13 receives a $(n+2)^{th}$ clock signal, and a second terminal of the thirteenth TFT NT13 is for outputting a $(n+2)^{th}$ gate driving signal G(n+2); a second terminal of the fifteenth TFT NT15 receives the high potential signal VGH, a first terminal of the fifteenth TFT NT15 is connected to the first terminal of the twelfth TFT NT12, and a third terminal of the fifteenth TFT NT15 is connected to the second terminal of the twelfth TFT NT12; the point connected between the twelfth TFT NT12 and the thirteenth TFT NT13 is used as a node Qb.

The point connected to the output terminal of the forward-reverse control module 30, the seventh TFT NT7 and the twelfth TFT NT12 is used as a node Q.

Wherein, the first terminal is one of source and drain, the second terminal is another one of source and drain, and the third terminal is gate.

There are four clock signals CK, that is, first clock signal, second clock signal, third clock signal and fourth clock signal, in the GOA circuit. When the $(n+1)^{th}$ clock signal CK(n+1) is the fourth clock signal, the $(n+2)^{th}$ clock signal should be the first clock signal. When the $(n+1)^{th}$ clock signal CK(n+1) is the second clock signal, the $(n-1)^{th}$ clock signal CK(n−1) should be the fourth clock signal. Furthermore, the forward-reverse scan control module 300 comprises a first TFT NT1 and a second TFT NT2.

A first terminal of the first TFT NT1 receives the forward scan control signal U2D, a first terminal of the second TFT NT2 receives the reverse scan control signal D2U, a second terminal of the first TFT NT1 is connected to a second terminal of the second TFT NT2 and the first terminal of the seventh TFT NT7, a third terminal of the first TFT NT1 receives a $(n-2)^{th}$ gate driving signal G(n−2), and a third terminal of the second TFT NT2 receives a $(n+4)^{th}$ gate driving signal G(n+4). The second terminal of the first TFT NT1 is further connected to the first terminal of the twelfth TFT NT12, and a point connected to the first TFT NT1, the seventh TFT NT7 and the twelfth TFT NT12 is the node Q.

When n≤2, the third terminal of the first TFT NT1 receives a scan start-up signal STV. When n+4>m, the third terminal of the second TFT NT2 receives the scan start-up signal STV. The scan star-up signal STV received by the third terminal of the first TFT NT1 could be the same as or different from the scan star-up signal STV received by the third terminal of the second TFT NT2.

Furthermore, the GOA unit further comprises a third TFT NT3, a fourth TFT NT4, an eighth TFT NT8, a tenth TFT NT10 and a fourteenth TFT NT14.

A first terminal of the third TFT NT3 receives a $(n+1)^{th}$ clock signal CK(n+1), and a first terminal of the fourth TFT NT4 receives a $(n-1)^{th}$ clock signal CK(n−1).

A second terminal of the third TFT NT3 is connected to a second terminal of the fourth TFT NT4 and a third terminal of the eighth TFT NT8.

A third terminal of the third TFT NT3 receives the forward scan control signal U2D, and a third terminal of the fourth TFT NT4 receives the reverse scan control signal D2U.

A first terminal of the eighth TFT NT8 receives the high potential signal VGH, and a second terminal of the eighth TFT NT8 is connected to a third terminal of the tenth TFT NT10 and a third terminal of the fourteenth TFT NT14.

A first terminal of the tenth TFT NT10 is connected to the second terminal of the ninth TFT NT9, a first terminal of the fourteenth TFT NT14 is connected to the second terminal of the thirteenth TFT NT13, and a second terminal of the tenth TFT NT10 and a second terminal of the fourteenth TFT NT14 both receive a low potential signal VGL.

Furthermore, the GOA unit further comprises an eleventh TFT NT11. A second terminal of the eleventh TFT NT11 is connected to a third terminal of the eleventh TFT NT11 and receives a reset signal Reset, and a first terminal of the eleventh TFT NT11 is connected to the third terminals of the tenth TFT NT10 and the fourteenth TFT NT14.

Furthermore, the GOA unit further comprises a sixth TFT NT6. A third terminal of the sixth TFT NT6 is connected to the second terminal of the second TFT NT2, a first terminal of the sixth TFT NT6 is connected to the third terminals of the tenth TFT NT10 and the fourteenth TFT NT14, and a second terminal of the sixth TFT NT6 receives the low potential signal VGL.

Furthermore, the GOA unit further comprises a first capacitor 1*l* and a second capacitor C2.

A first terminal of the first capacitor C1 is connected to the first terminals of the seventh TFT NT7 and twelfth TFT NT12, and a second terminal of the first capacitor C2 receives the low potential signa VGL.

One terminal of the second capacitor C2 is connected to the second terminal of the tenth TFT NT10, and another terminal of the second capacitor C2 is connected to the third terminal of the tenth TFT NT10.

Furthermore, the GOA unit further comprises a fifth TFT NT5. A second terminal of the fifth TFT NT5 receives the low potential signal VGL, a first terminal of the fifth TFT NT5 is connected to the first terminal of the seventh TFT NT7, and a third terminal of the fifth TFT NT5 is connected to the second terminal of the eighth TFT NT8.

Furthermore, all the TFT's in the GOA unit are N-channel TFT's.

Figure 4:
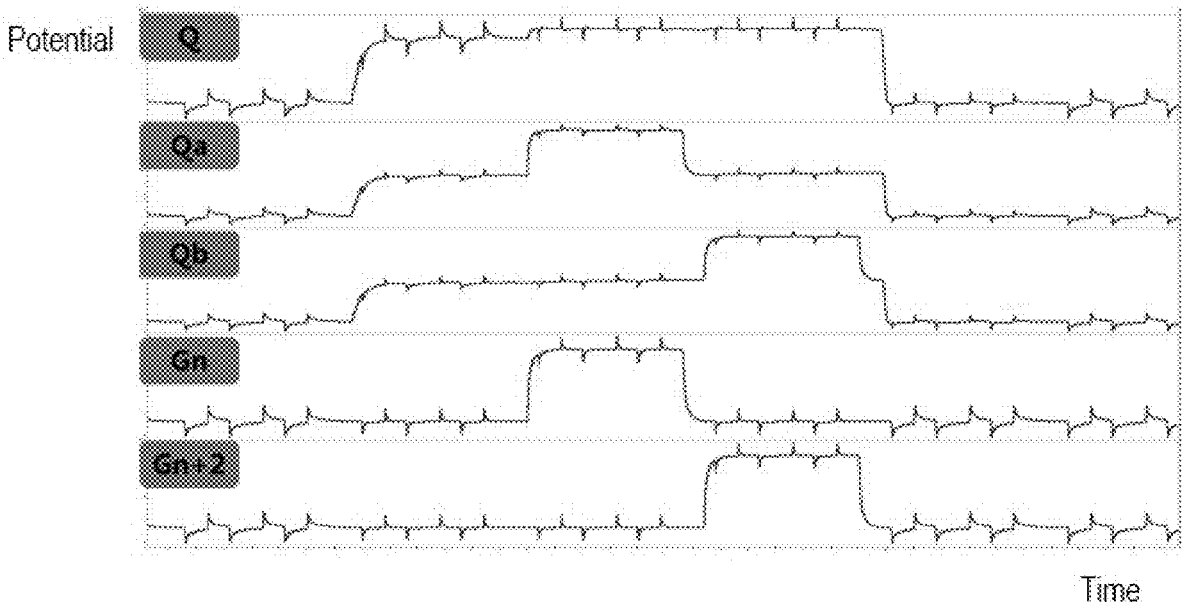
FIG. 4 is a waveform diagram showing waveforms of the node Q, Qa and Qb in the GOA circuit diagram and the output gate driving signals provided by the present disclosure.

Although there is also risk existed in reversely leaking potentials of the nodes Qa and Qb through the seventh TFT and the twelfth TFT in the boost period when the connecting point Q is interfered by signals, the present invention adds the fifteenth TFT NT 15 and the sixteenth TFT NT16 in the GOA unit so that, in the boost period of the nodes Qa and Qb, the fifteenth TFT NT15 and the sixteenth TFT NT16 are turned on through the potential pulled-up by boosting, and the high potential signal VGH is charged to the node Q to compensate the potential of the node Q so that the signal interference of the node Q is reduced. The waveform diagram of node Q is shown in FIG. 4. The potentials of the nodes Qa and Qb are kept at normal level and the gate potentials of the ninth TFT NT9 and the thirteenth TFT NT13 are kept at normal boost potential. Finally, the output waveforms of the $n^{th}$ gate driving signal G(n) and the $(n+2)^{th}$ gate driving signal G(n+2) could be in normal status and the risk of failure of GOA cascaded transmission is reduced.

The foregoing contents are detailed description of the disclosure in conjunction with specific preferred embodiments and concrete embodiments of the disclosure are not limited to these descriptions. For the person skilled in the art of the disclosure, without departing from the concept of the disclosure, simple deductions or substitutions can be made and should be included in the protection scope of the application.

What is claimed is:

1. A GOA circuit, which is used in a liquid crystal display panel, comprising m cascaded GOA units, wherein a $n^{th}$-stage GOA unit comprises: a forward-reverse scan control module, a first gate signal output module and a second gate signal output module, wherein $m \geq n \geq 1$;

the forward-reverse scan control module is used for controlling the GOA circuit to perform a forward scanning or a reverse scanning in accordance with a forward scan control signal or a reverse scan control signal;

the first gate signal output module comprises: a seventh thin film transistor (TFT), a ninth TFT and a sixteenth TFT; a third terminal of the seventh TFT receives a high potential signal, a first terminal of the seventh TFT is connected to an output terminal of the forward-reverse scan control module, and a second terminal of the seventh TFT is connected to a third terminal of the ninth TFT; a first terminal of the ninth TFT receives a $n^{th}$ clock signal, and a second terminal of the ninth TFT is for outputting a $n^{th}$ gate driving signal; a second terminal of the sixteenth TFT receives the high potential signal and thereby the second terminal of the sixteenth TFT and the third terminal of the seventh TFT are connected to receive the same high potential signal, a first terminal of the sixteenth TFT is connected to the first terminal of the seventh TFT, and a third terminal of the sixteenth TFT is connected to a node between the second terminal of the seventh TFT and the third terminal of the ninth TFT;

the second gate signal output module comprises: a twelfth TFT, a thirteenth TFT and a fifteenth TFT; a third terminal of the twelfth TFT receives the high potential signal, a first terminal of the twelfth TFT is connected to the output terminal of the forward-reverse scan control module, and a second terminal of the twelfth TFT is connected to a third terminal of the thirteenth TFT; a first terminal of the thirteenth TFT receives a $(n+2)^{th}$ clock signal, and a second terminal of the thirteenth TFT is for outputting a $(n+2)^{th}$ gate driving signal; a second terminal of the fifteenth TFT receives the high potential signal and thereby the second terminal of the fifteenth TFT and the third terminal of the twelfth TFT are connected to receive the same high potential signal, a first terminal of the fifteenth TFT is connected to the first terminal of the twelfth TFT, and a third terminal of the fifteenth TFT is connected to another node between the second terminal of the twelfth TFT and the third terminal of the thirteenth TFT;

wherein, the first terminal is one of source and drain, the second terminal is another one of source and drain, and the third terminal is gate.

2. The GOA circuit according to claim 1, wherein, the forward-reverse scan control module comprises a first TFT and a second TFT;

a first terminal of the first TFT receives the forward scan control signal, a first terminal of the second TFT receives the reverse scan control signal, a second terminal of the first TFT is connected to a second terminal of the second TFT and the first terminal of the seventh TFT, a third terminal of the first TFT receives a $(n-2)^{th}$ gate driving signal, and a third terminal of the second TFT receives a $(n+4)^{th}$ gate driving signal.

3. The GOA circuit according to claim 1, wherein the GOA unit further comprises a third TFT, a fourth TFT, an eighth TFT, a tenth TFT and a fourteenth TFT;

a first terminal of the third TFT receives a $(n+1)^{th}$ clock signal, and a first terminal of the fourth TFT receives a $(n-1)^{th}$ clock signal;

a second terminal of the third TFT is connected to a second terminal of the fourth TFT and a third terminal of the eighth TFT;

a third terminal of the third TFT receives the forward scan control signal, and a third terminal of the fourth TFT receives the reverse scan control signal;

a first terminal of the eighth TFT receives the high potential signal, and a second terminal of the eighth TFT is connected to a third terminal of the tenth TFT and a third terminal of the fourteenth TFT;

a first terminal of the tenth TFT is connected to the second terminal of the ninth TFT, a first terminal of the fourteenth TFT is connected to the second terminal of the thirteenth TFT, and a second terminal of the tenth TFT and a second terminal of the fourteenth TFT both receive a low potential signal.

4. The GOA circuit according to claim 3, wherein the GOA unit further comprises an eleventh TFT, a second terminal of the eleventh TFT is connected to a third terminal of the eleventh TFT and receives a reset signal, and a first terminal of the eleventh TFT is connected to the third terminals of the tenth TFT and the fourteenth TFT.

5. The GOA circuit according to claim 3, wherein the GOA unit further comprises a sixth TFT, a third terminal of the sixth TFT is connected to the second terminal of the second TFT, a first terminal of the sixth TFT is connected to the third terminals of the tenth TFT and the fourteenth TFT, and a second terminal of the sixth TFT receives the low potential signal.

6. The GOA circuit according to claim 3, wherein the GOA unit further comprises a first capacitor and a second capacitor;

a first terminal of the first capacitor is connected to the first terminal of the seventh TFT as well as the first terminal of the twelfth TFT, and a second terminal of the first capacitor receives the low potential signal different from the high potential signal received by each of the third terminal of the seventh TFT, the second terminal of the sixteenth TFT, the third terminal of the twelfth TFT and the second terminal of the fifteenth TFT;

a first terminal of the second capacitor is connected to the second terminal of the tenth TFT, and a second terminal of the second capacitor is connected to the third terminal of the tenth TFT.

7. The GOA circuit according to claim 3, wherein the GOA unit further comprises a fifth TFT, a second terminal of the fifth TFT receives the low potential signal, a first terminal of the fifth TFT is connected to the first terminal of the seventh TFT, and a third terminal of the fifth TFT is connected to the second terminal of the eighth TFT.

8. The GOA circuit according to claim 1, wherein all the TFT's in the GOA unit are N-channel TFT's.

9. A GOA circuit, which is used in a liquid crystal display panel, comprising m cascaded GOA units, wherein a $n^{th}$-stage GOA unit comprises: a forward-reverse scan control module, a first gate signal output module and a second gate signal output module, wherein $m \geq n \geq 1$;

the forward-reverse scan control module is used for controlling the GOA circuit to perform a forward scanning or a reverse scanning in accordance with a forward scan control signal or a reverse scan control signal;

the first gate signal output module comprises: a seventh thin film transistor (TFT), a ninth TFT and a sixteenth TFT; a third terminal of the seventh TFT receives a high potential signal, a first terminal of the seventh TFT is connected to an output terminal of the forward-reverse scan control module, and a second terminal of the seventh TFT is connected to a third terminal of the ninth TFT; a first terminal of the ninth TFT receives a $n^{th}$ clock signal, and a second terminal of the ninth TFT is for outputting a $n^{th}$ gate driving signal; a second terminal of the sixteenth TFT receives the high potential signal and thereby the second terminal of the sixteenth TFT and the third terminal of the seventh TFT are connected to receive the same high potential signal, a first terminal of the sixteenth TFT is connected to the first terminal of the seventh TFT, and a third terminal of the sixteenth TFT is connected to a node between the second terminal of the seventh TFT and the third terminal of the ninth TFT;

the second gate signal output module comprises: a twelfth TFT, a thirteenth TFT and a fifteenth TFT; a third terminal of the twelfth TFT receives the high potential signal, a first terminal of the twelfth TFT is connected to the output terminal of the forward-reverse scan control module, and a second terminal of the twelfth TFT is connected to a third terminal of the thirteenth TFT; a first terminal of the thirteenth TFT receives a $(n+2)^{th}$ clock signal, and a second terminal of the thirteenth TFT is for outputting a $(n+2)^{th}$ gate driving signal; a second terminal of the fifteenth TFT receives the high potential signal and thereby the second terminal of the fifteenth TFT and the third terminal of the twelfth TFT are connected to receive the same high potential signal, a first terminal of the fifteenth TFT is connected to the first terminal of the twelfth TFT, and a third terminal of the fifteenth TFT is connected to another node between the second terminal of the twelfth TFT and the third terminal of the thirteenth TFT;

the forward-reverse scan control module comprises a first TFT and a second TFT;

a first terminal of the first TFT receives the forward scan control signal, a first terminal of the second TFT receives the reverse scan control signal, a second terminal of the first TFT is connected to a second terminal of the second TFT and the first terminal of the seventh TFT, a third terminal of the first TFT receives a $(n-2)^{th}$ gate driving signal, and a third terminal of the second TFT receives a (n+4)th gate driving signal;

wherein, the first terminal is one of source and drain, the second terminal is another one of source and drain, and the third terminal is gate.

10. The GOA circuit according to claim 9, wherein the GOA unit further comprises a third TFT, a fourth TFT, an eighth TFT, a tenth TFT and a fourteenth TFT;

a first terminal of the third TFT receives a $(n+1)^{th}$ clock signal, and a first terminal of the fourth TFT receives a $(n-1)^{th}$ clock signal;

a second terminal of the third TFT is connected to a second terminal of the fourth TFT and a third terminal of the eighth TFT;

a third terminal of the third TFT receives the forward scan control signal, and a third terminal of the fourth TFT receives the reverse scan control signal;

a first terminal of the eighth TFT receives the high potential signal, and a second terminal of the eighth TFT is connected to a third terminal of the tenth TFT and a third terminal of the fourteenth TFT;

a first terminal of the tenth TFT is connected to the second terminal of the ninth TFT, a first terminal of the fourteenth TFT is connected to the second terminal of the thirteenth TFT, and a second terminal of the tenth TFT and a second terminal of the fourteenth TFT both receive a low potential signal.

11. The GOA circuit according to claim 10, wherein the GOA unit further comprises an eleventh TFT, a second terminal of the eleventh TFT is connected to a third terminal of the eleventh TFT and receives a reset signal, and a first terminal of the eleventh TFT is connected to the third terminals of the tenth TFT and the fourteenth TFT.

12. The GOA circuit according to claim 10, wherein the GOA unit further comprises a sixth TFT, a third terminal of the sixth TFT is connected to the second terminal of the second TFT, a first terminal of the sixth TFT is connected to the third terminals of the tenth TFT and the fourteenth TFT, and a second terminal of the sixth TFT receives the low potential signal.

13. The GOA circuit according to claim 10, wherein the GOA unit further comprises a first capacitor and a second capacitor;

a first terminal of the first capacitor is connected to the first terminal of the seventh TFT as well as the first terminal of the twelfth TFT, and a second terminal of the first capacitor receives the low potential signal different from the high potential signal received by each of the third terminal of the seventh TFT, the second terminal of the sixteenth TFT, the third terminal of the twelfth TFT and the second terminal of the fifteenth TFT;

a first terminal of the second capacitor is connected to the second terminal of the tenth TFT, and a second terminal of the second capacitor is connected to the third terminal of the tenth TFT.

14. The GOA circuit according to claim 10, wherein the GOA unit further comprises a fifth TFT, a second terminal of the fifth TFT receives the low potential signal, a first terminal of the fifth TFT is connected to the first terminal of the seventh TFT, and a third terminal of the fifth TFT is connected to the second terminal of the eighth TFT.

15. The GOA circuit according to claim 9, wherein all the TFT's in the GOA unit are N-channel TFT's.

16. A GOA circuit, which is used in a liquid crystal display panel, comprising m cascaded GOA units, wherein a $n^{th}$-stage GOA unit comprises: a forward-reverse scan control module, a first gate signal output module and a second gate signal output module, wherein $m \geq n \geq 1$;

the forward-reverse scan control module is used for controlling the GOA circuit to perform a forward scanning or a reverse scanning in accordance with a forward scan control signal or a reverse scan control signal;

the first gate signal output module comprises: a seventh thin film transistor (TFT), a ninth TFT and a sixteenth TFT; a third terminal of the seventh TFT receives a high potential signal, a first terminal of the seventh TFT is connected to an output terminal of the forward-reverse scan control module, and a second terminal of the seventh TFT is connected to a third terminal of the ninth TFT; a first terminal of the ninth TFT receives a $n^{th}$ clock signal, and a second terminal of the ninth TFT is for outputting a $n^{th}$ gate driving signal; a second terminal of the sixteenth TFT receives the high potential signal and thereby the second terminal of the sixteenth TFT and the third terminal of the seventh TFT are connected to receive the same high potential signal, a first terminal of the sixteenth TFT is connected to the first terminal of the seventh TFT, and a third terminal of the sixteenth TFT is connected to a node between the second terminal of the seventh TFT and the third terminal of the ninth TFT;

the second gate signal output module comprises: a twelfth TFT, a thirteenth TFT and a fifteenth TFT; a third terminal of the twelfth TFT receives the high potential signal, a first terminal of the twelfth TFT is connected to the output terminal of the forward-reverse scan control module, and a second terminal of the twelfth TFT is connected to a third terminal of the thirteenth TFT; a first terminal of the thirteenth TFT receives a $(n+2)^{th}$ clock signal, and a second terminal of the thirteenth TFT is for outputting a $(n+2)^{th}$ gate driving signal; a second terminal of the fifteenth TFT receives the high potential signal and thereby the second terminal of the fifteenth TFT and the third terminal of the twelfth TFT are connected to receive the same high potential signal, a first terminal of the fifteenth TFT is connected to the first terminal of the twelfth TFT, and a third terminal of the fifteenth TFT is connected to another node between the second terminal of the twelfth TFT and the third terminal of the thirteenth TFT;

the GOA unit further comprises a third TFT, a fourth TFT, an eighth TFT, a tenth TFT and a fourteenth TFT;

a first terminal of the third TFT receives a $(n+1)^{th}$ clock signal, and a first terminal of the fourth TFT receives a $(n-1)^{th}$ clock signal;

a second terminal of the third TFT is connected to a second terminal of the fourth TFT and a third terminal of the eighth TFT;

a third terminal of the third TFT receives the forward scan control signal, and a third terminal of the fourth TFT receives the reverse scan control signal;

a first terminal of the eighth TFT receives the high potential signal, and a second terminal of the eighth TFT is connected to a third terminal of the tenth TFT and a third terminal of the fourteenth TFT;

a first terminal of the tenth TFT is connected to the second terminal of the ninth TFT, a first terminal of the fourteenth TFT is connected to the second terminal of the thirteenth TFT, and a second terminal of the tenth TFT and a second terminal of the fourteenth TFT both receive a low potential signal;

the GOA unit further comprises an eleventh TFT, a second terminal of the eleventh TFT is connected to a third terminal of the eleventh TFT and receives a reset signal, and a first terminal of the eleventh TFT is connected to the third terminals of the tenth TFT and the fourteenth TFT;

wherein, the first terminal is one of source and drain, the second terminal is another one of source and drain, and the third terminal is gate.

17. The GOA circuit according to claim 16, wherein, the forward-reverse scan control module comprises a first TFT and a second TFT;

a first terminal of the first TFT receives the forward scan control signal, a first terminal of the second TFT receives the reverse scan control signal, a second terminal of the first TFT is connected to a second terminal of the second TFT and the first terminal of the seventh TFT, a third terminal of the first TFT receives a $(n-2)^{th}$ gate driving signal, and a third terminal of the second TFT receives a $(n+4)^{th}$ gate driving signal.

18. The GOA circuit according to claim 16, wherein the GOA unit further comprises a sixth TFT, a third terminal of the sixth TFT is connected to the second terminal of the second TFT, a first terminal of the sixth TFT is connected to the third terminals of the tenth TFT and the fourteenth TFT, and a second terminal of the sixth TFT receives the low potential signal.

19. The GOA circuit according to claim 16, wherein the GOA unit further comprises a first capacitor and a second capacitor;

a first terminal of the first capacitor is connected to the first terminal of the seventh TFT as well as the first terminal of the twelfth TFT, and a second terminal of the first capacitor receives the low potential signal different from the high potential signal received by each of the third terminal of the seventh TFT, the second terminal of the sixteenth TFT, the third terminal of the twelfth TFT and the second terminal of the fifteenth TFT;

a first terminal of the second capacitor is connected to the second terminal of the tenth TFT, and a second terminal of the second capacitor is connected to the third terminal of the tenth TFT.

20. The GOA circuit according to claim 16, wherein the GOA unit further comprises a fifth TFT, a second terminal of the fifth TFT receives the low potential signal, a first terminal of the fifth TFT is connected to the first terminal of the seventh TFT, and a third terminal of the fifth TFT is connected to the second terminal of the eighth TFT;

all the TFT's in the GOA unit are N-channel TFT's.

* * * * *